US008590240B2

(12) United States Patent
Koch

(10) Patent No.: US 8,590,240 B2
(45) Date of Patent: Nov. 26, 2013

(54) COMPRESSIVE FORCE TRANSMITTING CONNECTION ELEMENT

(75) Inventor: Georg Koch, Kirchhundem (DE)

(73) Assignee: TebeTec AG, Finsterhennen (CH)

( * ) Notice: Subject to any disclaimer, the term of this patent is extended or adjusted under 35 U.S.C. 154(b) by 0 days.

(21) Appl. No.: 13/300,597

(22) Filed: Nov. 20, 2011

(65) Prior Publication Data

US 2012/0159884 A1 Jun. 28, 2012

(30) Foreign Application Priority Data

Nov. 19, 2010 (EP) ..... 10191914
Jul. 12, 2011 (EP) ..... 11173639

(51) Int. Cl.
*E04B 1/686* (2006.01)
*E04F 15/14* (2006.01)

(52) U.S. Cl.
USPC ..... 52/396.05; 52/394; 52/395; 52/396.04

(58) Field of Classification Search
USPC ..... 52/250, 393, 394, 395, 396.04, 396.05, 52/396.08, 402, 403.1, 404.1
See application file for complete search history.

(56) References Cited

U.S. PATENT DOCUMENTS 8,132,388 B2 * 3/2012 Nagy et al. ..... 52/745.05
2004/0216404 A1 * 11/2004 Black ..... 52/250

FOREIGN PATENT DOCUMENTS

| | | |
|---|---|---|
| CH | 678 076 | 7/1991 |
| DE | 297 14 081 | 9/1997 |
| DE | 200 08 570 | 9/2001 |
| EP | 0 219 792 | 4/1987 |
| EP | 1 154086 | 1/2003 |

* cited by examiner

*Primary Examiner* — James Buckle, Jr.
(74) *Attorney, Agent, or Firm* — Cozen O'Connor

(57) ABSTRACT

Force transmitting connection for connecting first and second cast structural component parts having an insulation body for thermal separation of the cast structural component parts limited by two support surfaces. The first support surface faces the first cast structural component part and the second support surface faces the second cast structural component part. A compression element penetrates the insulation body from the first to the second support surface. An element for transmitting transverse force has at least one transverse force transmitting element that runs through the compressive force transmitting connection element from the first to the second support surface. The at least one compression element is connected to the at least one transverse force transmitting element and at least one pressure distributing element is formed at one end face of the compression element.

19 Claims, 7 Drawing Sheets

Prior Art

Prior Art

COMPRESSIVE FORCE TRANSMITTING CONNECTION ELEMENT

BACKGROUND OF THE INVENTION

1. Field of the Invention

The present invention is directed to a compressive force transmitting connection element suitable for the compressive force transmitting connection of a first cast structural component part to a second cast structural component part. A connection element of this kind generically comprises an insulation body (31) for thermal separation of the first cast structural component part (13, 29) from the second cast structural component part (15), this insulation body (31) being limited by two oppositely located support surfaces (39, 41), wherein the first support surface (39) limiting the insulation body (31) faces the first cast structural component part (13, 29), and wherein the second support surface (41) limiting the insulation body (31) faces the second cast structural component part (15), at least one compression element (33) penetrating the insulation body (31) from the first support surface (39) thereof to the second support surface (41) thereof, and a transmitting transverse force element.

2. Description of the Related Art

A heat insulating masonry unit is known from EP 2 151 531 A2. The compression elements of this heat insulating masonry unit are constructed from cement mortar and its heat insulating body preferably comprises glass foam or rock foam. In this instance, a structured surface to which grit is possibly applied serves for transmitting transverse force. A masonry unit of this kind is no doubt satisfactory with respect to heat insulation and with respect to transmission of compressive force, but the technical features suggested in the above-cited document are not persuasive with a view to the transmission of transverse force.

EP 0 338 972 A1 discloses a cantilever slab connection element by which balconies of cantilever slabs can be connected to an adjacent floor slab. The known cantilever slab connection element comprises a rectangular insulation body traversed by compression rods located one above the other in pairs and which run through the insulation body horizontally. To prevent rusting of these compression rods, which are preferably not produced from stainless steel for cost reasons, they are each enclosed by sleeves, and a hardenable material, e.g., a polymer-enhanced mortar, is injected between the sleeves and the compression rods. In one of its possible embodiments, the proposed cantilever slab connection element also has transverse force transmitting members, but they traverse the insulation body so as to be spatially separated from the compression rods.

The subject matter of WO 2010/046 841 A1 is a connection element for building connections in which an insulating body is traversed by reinforcement bars extending diagonally at an angle between 1° and 89° to the vertical which are connected in pairs to a reinforcing plate. Accordingly, the known connection element appears to have exclusively transverse force transmitting elements, since the reinforcing plate is not suitable as a compression element either with respect to its construction or with respect to its inclusion within the above-cited document. By the same token the document also does not propose the construction of pressure distributing elements of any kind.

A construction element for heat insulation in masonry is also known from DE 94 13 502 U1. While vertical supporting columns of cement mortar connected to one another by webs are disclosed as compression elements, the material for the heat insulating bodies comprises rigid foam polystyrene. However, there is no mention made within this document of elements for transmitting transverse force.

EP 1 154 086 A2 discloses a heat insulating element for heat flux decoupling between wall part and floor slab, discloses elements for transmitting transverse force. The known heat insulating element can have column-shaped supporting elements having an insulating element filling the intermediate spaces between these supporting elements. Anchor projections in the form of dowels arranged flat on the outer sides of the suggested heat insulating element serve as elements for transmitting transverse force and tensile force. This known type of heat insulating element may be feasible with respect to its heat insulation and can perhaps also contain light transverse forces which can occur when a known constructional member of this kind is transported; however, this document does not suggest an approach for a convincing solution to the problem of containing larger transverse forces such as those arising, for example, from systematic earth pressure or wind stabilization on a possible order of magnitude of at least greater than 10 kN/m.

EP 2 241 690 A2 discloses a connection element for the foundation of concrete structural component parts in which steel reinforced concrete columns and a concrete crossbeam supported by these columns are inserted in an insulation body for the connection of floors which is to be anchored therein. In a possible embodiment form, transverse force transmitting steel bars project downward out of the concrete columns.

Corresponding to known constructions for heat insulation, FIG. 1 shows the customary mounting of a concrete wall (15) on a concrete floor slab (13) with reference to a conventional concrete construction (11). The concrete floor slab (13) and the concrete wall (15) are connected to one another monolithically by frictional engagement without insulation. It can be seen that the heat insulation (5, 7) is provided on the outer side of and underneath the concrete floor slab (13) and also on the outer side of the concrete wall (15). For structural reasons, the heat insulation (7) which is arranged under the concrete floor slab (13) must be compression-resistant, age-resistant and rot-resistant depending on the degree of loading.

As a rule, the required compressive strength of the heat insulation (7) under the floor slab must be greater than 150 $kN/m^2$. The materials commonly used for this purpose are XPS panels, foam glass blocks or foam glass gravel. These are high-quality, compression-resistant materials. High compressive strengths result in lower heat insulating values at lambda >40 mW/mK. The comparatively high heat conductivity at constant thermal insulating power results in greater layer thicknesses and, therefore, higher materials consumption than comparable solutions with interior insulations. Further, the ecology of the building is negatively affected by the high consumption of resource-intensive materials (embodied energy). Nevertheless, for want of alternatives, this type of construction is used for low-energy and passive-house concepts.

The concrete construction (11) according to FIG. 2 is monolithic, frictionally engaging and only unsatisfactorily insulated. The heat insulation (5, 9) is arranged on the outer side of the outside wall (15) and is arranged so as to rest upon the concrete floor slab (13). The use of interior insulation (9) offers enormous cost savings as well as a reduction in the embodied energy required; however, this construction has the obvious disadvantage that a cold bridge exists between the concrete floor slab (13) and the concrete wall (15).

In FIGS. 3 and 4, a non-compression-resistant heat insulation (9) is arranged below and/or above a concrete (basement) ceiling (29) such as is applied, for example, for unheated basement rooms. A concrete construction (11) of this kind is likewise monolithic, frictionally engaging and only unsatisfactorily insulated. There is also a cold bridge between the concrete wall (15) and the concrete (basement) ceiling (29) in this solution. Systems of this kind are not suitable for low-energy houses or passive houses because of the local energy loss and the risk of mold growth (structural cold bridge).

SUMMARY OF THE INVENTION

Proceeding from the prior art evaluated above in the cited documents and shown in FIGS. 1 to 4. An object of the present invention is a connection element for two cast structural component parts which are to be connected to one another, i.e., preferably a concrete floor or concrete ceiling on the one hand and concrete wall on the other hand, which substantially eliminates the structural cold bridges commonly occurring in concrete constructions and which is equally able to absorb large compressive forces and large transverse forces. A further goal is to propose a solution by which concrete constructions can meet new and future energy standards at low financial and technical expenditure. Proceeding from this background, a key component within the object of the present invention is to afford the greatest possible freedom in the choice of material for the insulation body (31) without undue limitations as regards the height of the fresh concrete construction above the connection element (17). A further goal of the present invention is to make public a suggestion for a concrete construction having optimal flux of force and optimized heat insulation at the same time.

The above-stated object is met by a compressive force transmitting connection element (17) for a compressive force transmitting connection of a first cast structural component part (13, 29) to a second cast structural component part (15), at least having an insulation body (31) for thermal separation of the first cast structural component part (13, 29) from the second cast structural component part (15), this insulation body (31) being limited by two oppositely located support surfaces (39, 41), wherein the first support surface (39) limiting the insulation body (31) faces the first cast structural component part (13, 29), and wherein the second support surface (41) limiting the insulation body (31) faces the second cast structural component part (15), at least one compression element (33) penetrating the insulation body (31) from the first support surface (39) thereof to the second support surface (41) thereof, elements for transmitting transverse force, wherein the proposed connection element (17) is characterized in that the elements for transmitting transverse force comprise at least one transverse force transmitting element (35) that continuously runs through the compressive force transmitting connection element (17) in direction from the first support surface (39) of the insulation body (31) to the second support surface (41) of the insulation body (31), the at least one compression element (33) is connected by frictional engagement to the at least one transverse force transmitting element (35), at least one pressure distributing element (51) is formed at least at one end face of the at least one compression element (33).

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
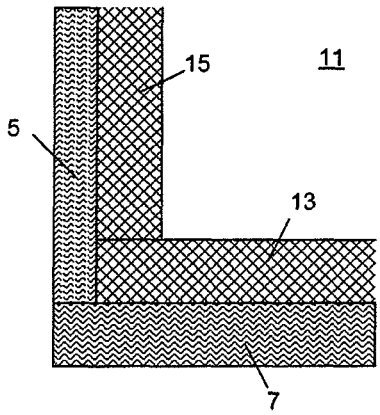
FIGS. 1-4 depict prior art concrete construction.

Without being limiting to these embodiment forms, the first cast structural component part (13, 29) is preferably an element selected from the list comprising concrete floor slab and concrete ceiling slab, while the second cast structural component part (15) is preferably a concrete wall. In these embodiment forms, the transverse force transmitting elements (35) which continuously run through the at least one compressive force transmitting connection element (17) can now be connected by frictional engagement to the concrete structural component parts (13, 15, 29) in that they are cast integral with the compressive force transmitting connection element (17) on one or both sides. It is precisely with respect to the casting particularly of high concrete walls (15) on the connection element (17) according to the invention that the construction of the at least one pressure distributing element (51) at least at one end face of the at least one compression element (33) offers key advantages. In particular, a preferred embodiment consists in that at least one pressure distributing element (51) is constructed at both of the two end faces of the at least one compression element (33). Accordingly, in the installed state the connection element (17) according to the invention is arranged between a concrete floor slab (13) and a concrete wall (15) or between a concrete ceiling slab (29) and a concrete wall (15) so that an efficient thermal separation between the two concrete parts is ensured. Without limiting thereto, it is preferable in accordance with all of the variants and embodiment forms suggested herein when the two cast structural component parts (13, 15, 29) with the connection element (17) according to one embodiment of the invention positioned therebetween are situated one on the top of the other in a layered manner in the installed state.

The at least one pressure distributing element (51) at the at least one end face of the at least one compression element (33) or, equally preferably, the at least one pressure distributing element (51) at both of the two end faces of the at least one compression element, (33) is preferably constructed either to be flush at the outer surface with the support surfaces (39, 41) limiting the insulation body (31) or to project beyond the support surfaces (39, 41) limiting the insulation body (31).

With respect to the connection element (17) proposed herein that adjoins the first support surface (39) limiting the insulation body (31) and/or adjoins the second support surface (41) limiting the insulation body (31), the area of the pressure distributing element (51) when exactly one pressure distributing element (51) is formed or the total area of pressure distributing elements (51) when a plurality of pressure distributing elements (51) is formed preferably accounts for 3% to 100%, preferably 20% to 100%, and particularly preferably 35% to 100%, of either the first support surface (39) limiting the insulation body (31) or the second support surface (41) limiting the insulation body (31). While the at least one pressure distributing element (51) is a determining factor for the height of the freshly poured concrete construction above the connection element (17) according to one embodiment of the invention and is a determining factor for the freedom in the choice of material for the insulation body (31), the compression elements (33) chiefly ensure that the structural component part resting on the connection element (17) transmits the resultant compressive force proceeding from the building after the concrete has cured.

Within the framework of a first preferred constructional variant, the at least one pressure distributing element (51) is constructed as exactly one pressure distributing plate per support surface (39, 41) limiting the insulation body (31) formed, e.g., of concrete, steel reinforced and/or plastic reinforced concrete, particularly plastic-enclosed steel or carbon fiber reinforced plastic. When there is a plurality of compression elements (33) within the proposed compressive force transmitting connection element (17), an exactly one pressure distributing plate of this kind presents a connecting, stability-enhancing connective element.

Within the framework of a second preferred constructional variant, the at least one pressure distributing element (51) is formed as a plurality of adjacent pressure distributing plates (51) that mesh with one another, preferably exactly one pressure distributing plate (51) is associated with each compression element (33) within the proposed compressive force transmitting connection element (17), and every compression element (33) is terminated preferably at both end faces, particularly on the top and bottom, by a pressure distributing plate (51) associated with the compression element (33).

Besides the pressure distributing plates suggested in the preceding two paragraphs as preferred constructional variants of the pressure distributing elements (51) according to one embodiment of the invention, the following examples of a pressure distributing element (51) of this kind are also conceivable and, moreover, are preferably:

- rods, particularly comprising metal or plastic-encased metal, which extend in a straight line and run parallel to the support surfaces (39, 41) limiting the insulation body (31),
- rods, particularly comprising metal or plastic-encased metal, which are curved or are bent helically and extend in a plane parallel to the support surfaces (39, 41) limiting the insulation body (31),
- grates, particularly comprising metal, plastic-encased metal, fiber reinforced plastics, or plastics, extending in a plane parallel to the support surfaces (39, 41) limiting the insulation body (31).

The insulation body (31) provided for the thermal separation of the first cast structural component part (13, 29) from the second cast structural component part (15) preferably has a stiffness modulus greater than 80 N/mm$^2$, preferably greater than 100 N/mm$^2$ and particularly preferably greater than 150 N/mm$^2$. This has the advantage that the at least one compression element (33), or the constructed plurality of compression elements (33), is supported by the surrounding material of the insulation body (31) and exposed to only especially small shear forces if any. Without limiting exclusively thereto, the materials available for the insulation body (31) include: foam glass, expanded hard polystyrene foam (EPS), and XPS.

A particularly preferred material for producing the insulation body is foam glass. In particular, apart from a compressive strength of greater than 200 kN/m$^2$, foam glass has a stiffness modulus of greater than 80 N/mm$^2$.

Because of the exposed position of the connection element (17), the insulation body (31) is fashioned from a waterproof material and particularly preferably impervious to water vapor, preferably age-resistant, and resistant to pests and rot. These requirements are also met to an outstanding degree by the foam glass which is particularly preferred.

According to one embodiment of the invention, the insulation body (31) is penetrated at least by exactly one compression element (33). In such a case, for purposes of the required absorption of compressive forces and shear forces, this compression element (33), if only one such compression element (33) is provided, has a greater extension in the longitudinal axis and transverse axis than would be the case if the insulation body (31) were penetrated by a plurality of compression elements (33) constructed so as to be spaced apart from one another. In this connection, it is preferable that the cross-sectional area of the compression element (33) when there is exactly one compression element (33) penetrating the insulation body (31), or the sum of the cross-sectional areas of the compression elements (33) when there is a plurality of compression elements (33) penetrating the insulation body (31), accounts for 0.3% to 62.5%, particularly preferably—especially when the material for the compression elements (33) penetrating the insulation body (31) is concrete—4% to 25%, and better yet 4% to 15%, of either the first support surface (39) limiting the insulation body (31) or the second support surface (41) limiting the insulation body (31). When steel or materials of similar strength are chosen as material for the compression elements (33) penetrating the insulation body (31), the percentage is particularly preferably 0.3% to 4.5% of either the first support surface (39) limiting the insulation body (31) or the second support surface (41) limiting the insulation body (31). When the cross-sectional area of the one compression element (33) or of the plurality of compression elements (33) varies over the length thereof, the minimum cross-sectional area determined at the position of the respective compression element (33) where the cross-sectional area thereof reaches the lowest possible value is the quantity to be taken into account.

The at least one compression element (33) according to one embodiment of the invention penetrates the insulation body (31) from the first support surface (39) thereof to the second support surface (41) thereof is advantageously produced from steel, stainless steel, fiber reinforced plastic, concrete, fiber reinforced concrete, or another compression-resistant, i.e., substantially non-compressible, material. Especially preferred are concrete, fiber reinforced concrete and fiber reinforced plastic because in this case the at least one compression element (33) also guarantees good thermal insulation between the two support surfaces (39, 41) limiting the insulation body (31). The compression element (33) is advisably inserted into the insulation body (31) so as to be free from slippage. This has the advantage that the at least one compression element (33) obtains additional stability through the surrounding insulation body (31).

Figure 11:
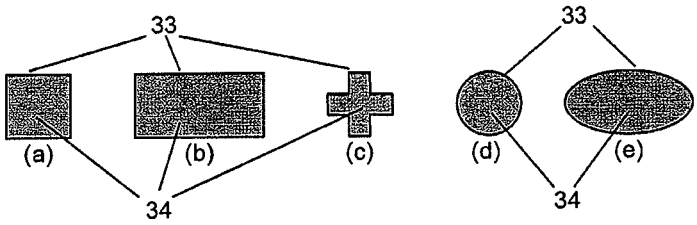
FIGS. 11 and 12 are compression elements.

According to the embodiment examples shown in FIG. 11, a-e, the at least one compression element (33) can have at its ends fundamentally different bases (34) such as square (a), rectangular (b), cross profile (c), round (d), oval, or elliptical (e), etc.

Figure 12:
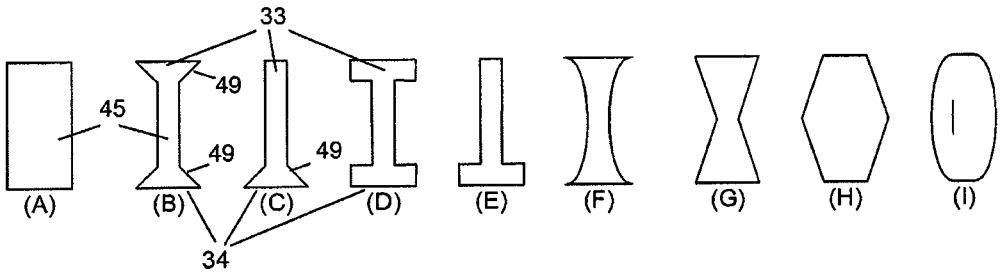

The compression elements (33) according to FIG. 12 can likewise have different body shapes (45) in longitudinal section. The body (45) of the compression elements (33) between the bases (34) thereof at the two ends can be cylindrical (A), reduced in diameter relative to one (C, E) or both bases (B, D, F, G), or can be curved inward (F) or outward (I).

The embodiment example (F) according to FIG. 12 in which the cross section of the at least one compression element (33) is reduced in diameter toward the center is especially preferred.

The at least one compression element (33) or, in case of a plurality of compression elements (33), at least a majority of these compression elements (33) is preferably arranged on the longitudinal center axis (A) (also known in technical jargon as the system axis) of the connection element (17) (see FIGS. 8 and 9) or at a distance therefrom. In the latter case, the compression elements (33) are preferably arranged relative to one another in such a way that the resultant of the transmissible compressive force in turn lies approximately on the longitudinal center axis (A) (symmetrical arrangement). In an asymmetrical arrangement of compression elements (33) outside the longitudinal center axis of the connection element (17), e.g., for purposes of optimizing the flux of force, the arrangement is carried out in a particularly preferred manner in such a way that the resultant compressive force is located off center by at most one-third of the cross-sectional width of the connection element (17).

According to one embodiment of the invention, the proposed compressive force transmitting connection element (17) has, for transmitting transverse force, at least one transverse force transmitting element (35) that continuously runs through the connection element (17) and is connected by frictional engagement to the at least one compression element (33). By "continuously" is meant within the meaning of the present Application that the transverse force transmitting element (35) passes through the connection element (17) without material gaps. The transverse force transmitting element (35) can comprise a plurality of individual pieces which have been glued, welded or otherwise permanently connected to one another before insertion into the connection element (17). In a particularly preferred manner within the meaning of the present Application, the transverse force transmitting element (35) runs through the connection element (17) in one piece; in other words, the transverse force transmitting element (35) is formed of an individual workpiece which is not composite, but rather extends uninterruptedly.

The frictionally engaging connection between the at least one compression element (33) and the at least one transverse force transmitting element (35) is preferably formed as a connection selected from the list comprising glue joint, weld joint, brazed joint, integrally cast joint, and joint by enclosure over at least a portion of the circumference. Gluing, welding and brazing can be carried out only in a pointwise or sectionwise manner; however, it is particularly preferable that this type of frictionally engaging connection is carried out in that the at least one compression element (33) is glued, welded or brazed to the at least one transverse force transmitting element (35) along the entire contact surface therebetween. Another preferred form of the frictionally engaging connection between the at least one compression element (33) and the at least one transverse force transmitting element (35) consists in that the at least one compression element (33) is enclosed over at least part of its circumference by the at least one transverse force transmitting element (35) or in a particularly preferred manner in that the at least one transverse force transmitting element (35) is enclosed over at least part of its circumference by the at least one compression element (33). Combinations of the types of connections mentioned above are possible and deemed as preferable within the meaning of the present invention.

In accordance with the latter suggestion in the preceding paragraph, the transverse force transmitting element (35) can be enclosed over at least part of its circumference by the at least one compression element (33), which means within the meaning of the present Application that at least one eighth of the circumference of the transverse force transmitting element (35) is directly adjacent to and frictionally connected to and/or enclosed by the compression element (33) over at least 25% of the length of the compression element (33) measured between the two support surfaces (39, 41) of the insulation body (31). In a particularly preferable manner, the transverse force transmitting element (35) is enclosed over at least one fourth or, better yet, at least one half of its circumference by the at least one compression element (33), which means within the meaning of the present Application that at least one half of the circumference of the transverse force transmitting element (35) is directly adjacent to and frictionally connected to and/or enclosed by the compression element (33) over at least 25% of the length of the compression element (33) measured between the two support surfaces (39, 41) of the insulation body (31). It is particularly preferable that the transverse force transmitting element (35) is enclosed over its full circumference by the at least one compression element (33), which means within the meaning of the present Application that the transverse force transmitting element (35) is formed within this compression element (33) along the full length of the compression element (33) and is thus connected to the compression element (33) by frictional engagement and material bonding. Rod-shaped elements (e.g., straight or curved reinforcement bars) and plate-shaped members as well as diverse other profile constructions can be used for the transverse force transmitting element (35).

The at least one transverse force transmitting element (35) is preferably rod-shaped and runs through the connection element (17) in a straight line. In another preferred embodiment, the transverse force transmitting element (35) projects beyond the first support surface (39) facing the first cast structural component part (13, 29) on one side and projects beyond the second support surface (41) facing the second cast structural component part (15) on the other side, particularly preferably by a length in a range from 2 to 100 cm, more restrictedly in a range from 4 to 70 cm, and still more restrictedly in a range from 4 to 50 cm. In this way, a frictionally engaging connection of the transverse force transmitting elements (35) to the possible reinforcement in the middle of the first cast structural component part (13, 29) and second cast structural component part (15), respectively, can be made possible in a particularly satisfactory manner.

Within the framework of another preferred embodiment form, it is provided that the element for transmitting transverse force comprises at least one pair of two rod-shaped transverse force transmitting elements (35) which are connected, respectively, to the at least one compression element (33) by frictional engagement. When there is a plurality of compression elements (33) and a plurality of transverse force transmitting elements (35) within the proposed connection element (17), it is particularly preferred when the transverse force transmitting elements (35) are connected at least for the most part in pairs to at least one compression element (33) by frictional engagement. In a possible embodiment form, a pair of two preferably rod-shaped transverse force transmitting elements (35) is enclosed over at least part of its circumference, particularly preferably even completely, by a compression element (33).

Within the framework of the above-mentioned embodiment form and also in general, it is preferable when the transverse force transmitting elements (35) forming the at least one pair, or the transverse force transmitting elements (35) generally, are angled at least in some areas outside the insulation body (31). The angled areas are also designated as extensions (60). In particular, an angling of the extensions (60) has the advantage that the elements provided according to the invention for transmitting transverse forces also ensure transmission of tensile forces so that a construction of this kind allows a particularly stable building construction, particularly a concrete building construction (11), which makes it possible to connect the first cast structural component part (13, 29) to the second cast structural component part (15) in such a way that the transverse forces can also be carried off in diametrically opposite directions.

Further within the framework of the embodiment forms having transverse force transmitting elements (35) which are constructed in pairs, it is preferable when the transverse force transmitting elements (35) forming the at least one pair are constructed so as to intersect in the middle inside the at least one compression element (33). In so doing, it is conceivable in particular that when there is a plurality of compression elements (33) penetrating the insulation body (31) these compression elements (33) are: partially traversed by a pair of at least two, preferably exactly two, rod-shaped transverse force transmitting elements (35) which are angled at least in some areas and which are constructed so as to intersect inside the respective compression elements (33); partially traversed by a pair of at least two, preferably exactly two, rod-shaped transverse force transmitting elements (35) which are constructed in a straight line along their entire length.

With respect to the transverse force transmitting elements (35) which are constructed in a rod-shaped manner so as to intersect, it is preferable when these two transverse force transmitting elements (35) are directly frictionally connected to one another at the point of intersection, possibly by gluing or welding. It is equally preferable when the two intersecting transverse force transmitting elements (35) are indirectly frictionally connected to one another in that they are frictionally connected, respectively, to at least one common compression element (33). It is also conceivable and equally preferable when the two transverse force transmitting elements (35) are fixed at the point of intersection exclusively by the material of the compression element (33) enclosing the two transverse force transmitting elements (35) over at least part of their circumference. In all of the cases described above and without limiting to possible embodiment forms, the transverse force transmitting elements (35) are each preferably made of a material selected from the list comprising steel, structural steel, stainless steel, and fiber reinforced plastic (GRP=glass fiber reinforced plastic, CRP=carbon fiber reinforced plastic), particular preference being given to structural steel and stainless steel.

Further within the framework of the embodiment forms having transverse force transmitting elements (35) which are constructed in pairs, it is preferable when the transverse force transmitting elements (35) forming the at least one pair are connected to one another at least once at a distance from one another outside the insulation body (31). This type of connection of the transverse force transmitting elements (35) outside the insulation body (31) can be combined in a particularly preferred manner with the construction in which the intersecting transverse force transmitting elements (35) are indirectly frictionally connected to one another by respective frictional connection to at least one common compression element (33). This type of connection of the transverse force transmitting elements (35) outside the insulation body (31) can be combined in an equally particularly preferred manner with the construction according to which the transverse force transmitting elements (35) are constructed so as to intersect in the middle inside the at least one compression element (33) as well as with the construction according to which the transverse force transmitting elements (35) which are formed in pairs are constructed so as to extend in a straight line up to their connection to one another at a distance from one another outside the insulation body (31) and in so doing penetrate the insulation body (31) particularly in a straight line and parallel to one another.

According to a preferred constructional variant, the ratio between transmissible compressive force, chiefly influenced by the compression elements (33), and the transverse force to be transmitted, chiefly influenced by the transverse force transmitting elements (35) and their frictionally engaging connection to the compression elements (33), measured in transmissible force units, respectively, is greater than 2:1, preferably greater than 4:1, and particularly preferably greater than 5:1. In accordance with the preferred constructional variants, this means that the connection element (17) according to one embodiment of the invention is capable of transmitting more, particularly preferably substantially more, compressive force than transverse force. The force units that can be transmitted through an element can be determined by loading the elements to failure.

The connection element (17) according to the invention can be constructed as a body having a polygonal cross section (e.g., a hexagonal body, an octagonal body) and having two first and second flat sides located opposite one another and parallel to one another and which correspond to the two oppositely located support surfaces (39, 41) limiting the insulation body (31) and are situated parallel to the two support surfaces (39, 41) when pressure distributing plates (51) project out over the support surfaces (39, 41). However, the connection element (17) according to one embodiment of the invention is advantageously constructed as a rectangular body. This has the advantage that the lateral surfaces of the connection element (17) can be flush with the concrete walls (15) resting upon them.

The invention is also equally directed to the use of the compressive force transmitting connection element (17) proposed herein in all of its possible embodiment forms and variants as thermally insulating and, at the same time, statically reinforcing connection components between two cast structural component parts (13, 15, 29) which are preferably positioned one above the other.

Figure 2:
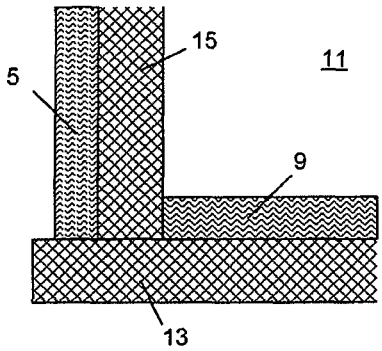
Prior Art Figure 2
Figure 3:
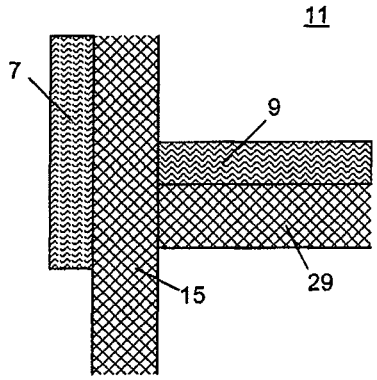
Figure 4:
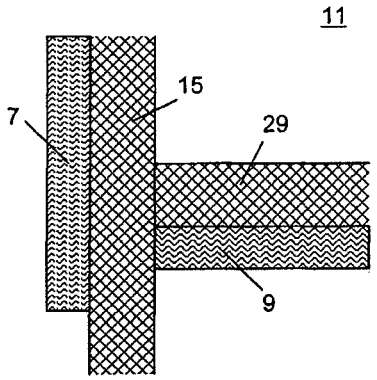
Prior Art Figure 4
Figure 5:
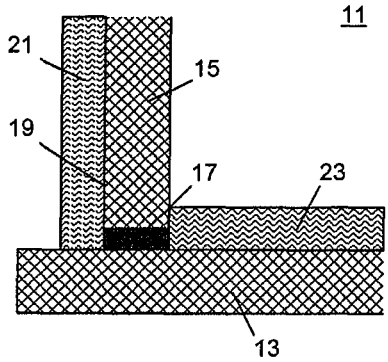
FIGS. 5-7 depict concrete construction according to the present invention.

In the embodiment which is illustrated in FIG. 5 and which shows a construction situation comparable to that shown in FIG. 2, a concrete wall (15)—as an example of a vertical concrete structural component part (15)—is to be arranged on a concrete floor slab (13) which is arranged on soil and which serves as an example of a horizontal concrete structural component part, a compressive force transmitting connection element (17) according to the invention being positioned therebetween. The connection element (17) positioned in this way presents a rectangular body having a low thermal conductivity coefficient of less than 60 mW/mK in the present case, which is capable of thermally separating the one concrete part (15) from an adjoining concrete part (13) within the concrete construction (11) shown in the drawing. An exterior insulation (21) corresponding to the prior art is arranged at the outer side (19) of the concrete wall (15) and also covers the outer side of the connection element (17) for the most part and preferably completely. In the present case, the concrete floor slab (13) projects beyond the concrete wall (15) by a certain amount and the exterior insulation (21) leads up to the concrete floor slab (13). An interior insulation (23) is provided on the concrete floor slab (13) in the interior area of the house. Obviously, the concrete construction (11) shown in this instance is completely thermally separated from the environment. Therefore, the concrete construction (11) according to the invention shown in FIG. 5 corresponds to the thermally optimal construction according to FIG. 1 because there is also no structural cold bridge in this case.

Figure 6:
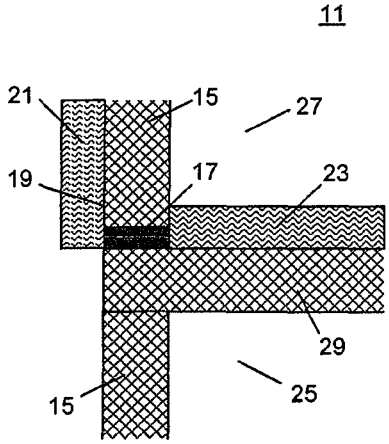

The embodiment example according to the invention illustrated in FIG. 6 is a concrete construction (11) in which a basement (25) is separated from a story (27) located above it by a concrete basement ceiling (29). Like the concrete construction (11) according to FIG. 5, the rising concrete wall (15) is mounted at the level of the story (27) on a compressive force transmitting connection element (17) according to the invention, and the interior insulation (23) is arranged on the basement ceiling (29). The exterior insulation (21) also covers the outer side of the connection element (17) for the most part and preferably completely so that the story (27) is also mostly thermally insulated from the basement (25) and the environment in this construction.

Figure 7:
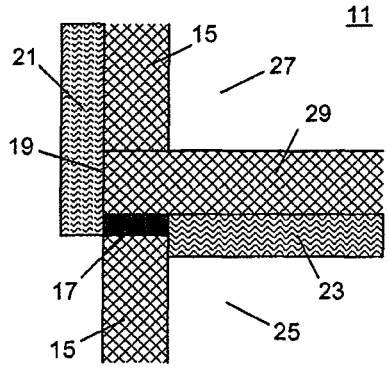

The concrete construction (11) according to the embodiment example according to the invention which is depicted in FIG. 7 differs from the concrete construction (11) in FIG. 6 in that the basement ceiling (29) in this case rests on a compressive force transmitting connection element (17) according to the invention. Correspondingly, the interior insulation (23) is arranged below rather than above the basement ceiling (29). It can again be seen that the basement (25) is thermally insulated from the building construction above it by the connection element (17) and the interior insulation (23).

Figure 8:
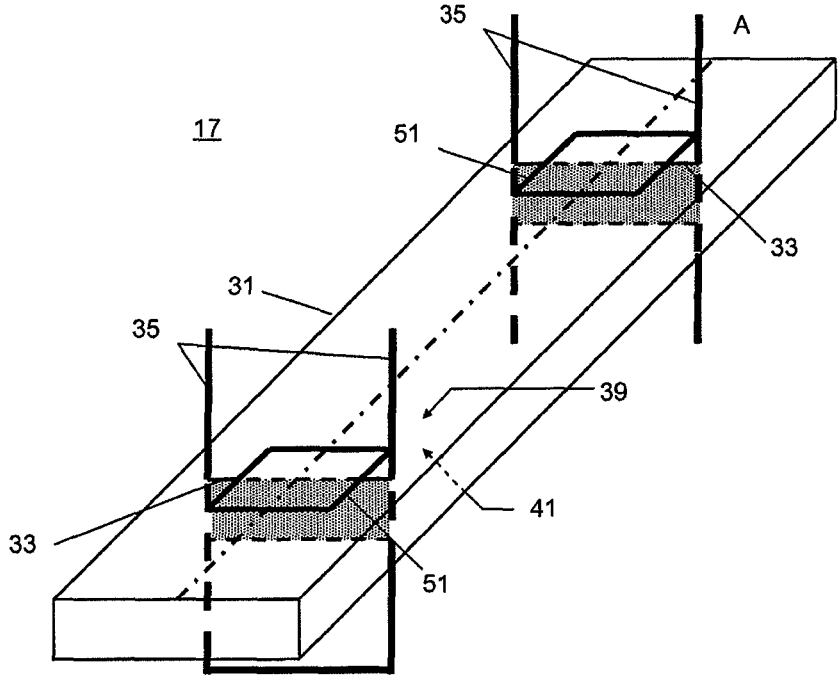
FIGS. 8 and 9 depict compressive force transmitting connective elements.

A compressive force transmitting connection element (17) according to the invention is shown in FIG. 8 unconnected to any installation situations in a characteristic, but not limiting and to this extent freely selected, embodiment form such as can be used for the above-described concrete constructions according to FIGS. 5 to 7. The compressive force transmitting connection element (17) has in this instance a rectangular insulation body (31) which is fabricated, e.g., from XPS in the present case and which is limited on the top by the first plane support surface (39) and on the bottom by the second support surface (41) which is oriented in a planar manner and parallel to the first support surface (39). In the installed state of the connection element (17), these support surfaces (39, 41) face the two cast structural component parts (13, 15, 29), not shown in FIG. 8.

In the present instance, the insulation body (31) is penetrated by two plate-shaped compression elements (33), indicated by hatching, in upended rectangle orientation which are made of steel or fiber reinforced plastic in the present case. The compression elements (33) have a pressure distributing element (51) in each instance at their upper end faces which in the present case terminates flush with the outer side of the support surface (39) limiting the insulation body (31) on top.

The two compression elements (33) centrically intersecting the longitudinal center axis (A) of the connection element (17) are each limited on the outer side by a pair of two rod-shaped transverse force transmitting elements (35) extending in a straight line and are connected with the latter by frictional engagement. The transverse force transmitting elements (35) project out of the first, upper support surface (39) and out of the second, bottom support surface (41), respectively, by a length of 35 cm in the present case. In one case, i.e., in the front referring to FIG. 8, the two transverse force transmitting elements (35) are connected to one another once at a distance from one another outside the insulation body (31), in the present case underneath the connection element (17).

Figure 10:
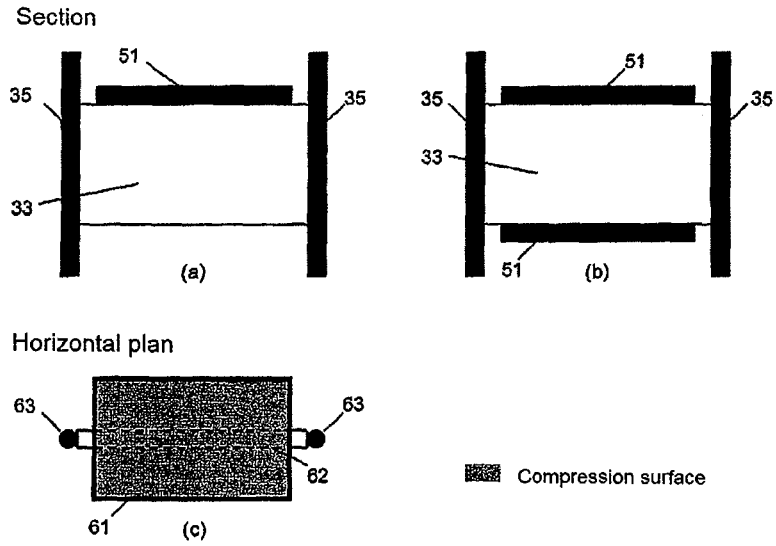
FIG. 10 is a plate-shaped compression element.

Two possible embodiments of plate-shaped compression elements (33) to be oriented in the manner of an upended rectangle, each having a pair of two rod-shaped transverse force transmitting elements (35) extending in a straight line, are shown in section in FIG. 10. The transverse force transmitting elements (35) limit the plate-shaped compression elements (33) on the outer side and are connected thereto by frictional engagement. FIG. 10 (*a*) corresponds to the plate-shaped compression elements (33) from FIG. 8, where a pressure distributing element (51) is formed in each instance only at the upper end faces of the compression elements (33). In FIG. 10 (*b*), pressure distributing elements (51) are formed at both end faces, both at the top and at the bottom in this case. FIG. 10 (*c*) shows the arrangements from FIGS. 10 (*a*) and (*b*) in a horizontal plan view (viewed from above).

Figure 9:
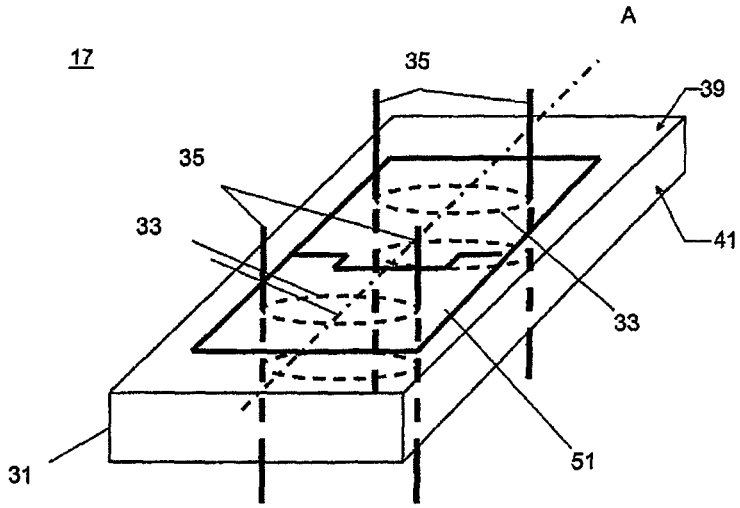

In contrast to FIG. 8, FIG. 9 shows a compressive force transmitting connection element (17) according to the invention in a characteristic, but not limiting and to this extent freely selected, embodiment form such as can also be used for the above-described concrete constructions according to FIGS. 5 to 7. In this case, the compressive force transmitting connection element (17) again has a rectangular insulation body (31) fabricated from XPS in the present case and which is limited on the top by the first plane support surface (39) and on the bottom by the second support surface (41) which is oriented in a planar manner and parallel to the first support surface (39). In the installed state of the connection element (17), these support surfaces (39, 41) face the two cast structural component parts (13, 15, 29), not shown.

As is shown, the insulation body (31) is penetrated by two cylindrical compression elements (33) which are made of concrete or fiber reinforced plastic in the present case, wherein a hexagonal pressure distributing element (51) is formed in each instance at least in direction of the first plane support surface (39). In the present case, the two adjacent pressure distributing elements (51) mesh one inside the other by the hexagonal construction with the limiting sides engaging one inside the other.

Figure 13:
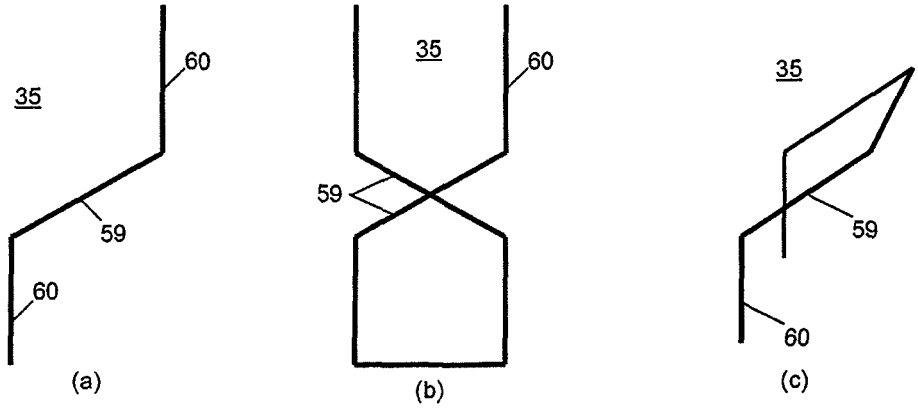

FIG. 13 shows three different embodiment forms for the transverse force transmitting elements (35) which are frictionally connected, respectively, with the at least one compression element (33) penetrating the insulation body (31) from the first support surface (39) thereof to the second support surface (41) thereof. The transverse force transmitting elements (35) are preferably formed by rods of structural steel or stainless steel. According to a first embodiment form shown in FIG. 13*a*, a transverse force transmitting element (35) of this kind comprises a center portion (59), which is angled at least in some areas outside the insulation body (31), not shown in FIG. 13*a*. The angled areas are designated in this instance as extensions (60). According to FIG. 13*b*, the transverse force transmitting element (35) can also comprise two rods that intersect in the respective center portion (59) thereof and which are lengthened at one end by the extensions (60) projecting at an angle. In the installed state, the point of intersection of the rods is located approximately in the middle of the insulation body (31). The other ends are lengthened in such a way that they are connected to one another at a distance from one another outside the insulation body (31) in the installed state. In another embodiment the transverse force transmitting elements (35) according to FIG. 13*c*, the transverse force transmitting element (35) has the shape of an angled "U". The transverse force transmitting elements (35) are preferably installed in the insulation body (31) in such a way that the center portion (59) which is angled relative to the extensions (60) extends approximately transverse to the longitudinal center axis (A) of the connection element (17).

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A compressive force transmitting connection element for compressive force transmitting connection of a first cast structural component part to a second cast structural component part, comprising:

an insulation body for thermal separation of the first cast structural component part from the second cast structural component part, the insulation body limited by two oppositely located support surfaces, the first support surface arranged to face the first cast structural component part and the second support surface arranged to face the second cast structural component part;

at least one compression element penetrating the insulation body from the first support surface to the second support surface;

an element for transmitting transverse force that comprises at least one transverse force transmitting element that continuously runs through the compressive force transmitting connection element in from the first support surface of the insulation body to the second support surface of the insulation body, wherein the at least one compression element is connected by frictional engagement to the at least one transverse force transmitting element; and at least one pressure distributing element formed at least at one end face of the at least one compression element.

2. The compressive force transmitting connection element according to claim 1, wherein the first cast structural component part is one of a concrete floor slab and a concrete ceiling slab.

3. The compressive force transmitting connection element according to claim 2, wherein the second cast structural component part is a concrete wall.

4. The compressive force transmitting connection element according to claim 1, wherein the at least one pressure distributing element is arranged to be one of flush at an outer surface of the support surfaces limiting the insulation body and to project over the support surfaces limiting the insulation body.

5. The compressive force transmitting connection element according to claim 1, wherein a total area of the at least one pressure distributing element is for 3% to 100% of one of the first support surface limiting the insulation body and the second support surface limiting the insulation body.

6. The compressive force transmitting connection element according to claim 1, wherein the frictionally engaging connection between the at least one compression element and the at least one transverse force transmitting element is at least one of a glue joint, a weld joint, a brazed joint, an integrally cast joint, and a joint by enclosure over at least a portion of a circumference of the at least one transverse force transmitting element.

7. The compressive force transmitting connection element according to patent claim 6, wherein the at least one compression element encloses the at least one transverse force transmitting element over its full circumference.

8. The compressive force transmitting connection element according to claim 1, wherein the transverse force transmitting element is rod-shaped and runs through the connection element in a substantially straight line.

9. The compressive force transmitting connection element according to claim 1, wherein the element for transmitting transverse force comprises at least one pair of two rod-shaped transverse force transmitting elements connected, respectively, to the at least one compression element by frictional engagement.

10. The compressive force transmitting connection element according to claim 8, wherein at least one of the transverse force transmitting elements comprises an angled portion external to the insulation body.

11. The compressive force transmitting connection element according to claim 9, wherein the transverse force transmitting elements forming the at least one pair of transverse force transmitting elements is constructed to intersect at a middle inside the at least one compression element.

12. The compressive force transmitting connection element according to claim 9, wherein the transverse force transmitting elements forming the at least one pair of transverse force transmitting elements is connected to one another at least once at a distance from one another outside the insulation body.

13. The compressive force transmitting connection element according to claim 1, wherein one of a cross-sectional area of the compression element when there is exactly one compression element penetrating the insulation body and a sum of cross-sectional areas of the compression elements when there is a plurality of compression elements penetrating the insulation body, accounts for 0.3% to 62.5% of one of the first support surface limiting the insulation body or the second support surface limiting the insulation body.

14. The compressive force transmitting connection element according to claim 1, wherein a ratio between transmissible compressive force and transverse force measured in transmissible force units is greater than 2:1.

15. The compressive force transmitting connection element according to claim 1, wherein a cross section of the at least one compression element is reduced in diameter toward its center.

16. The compressive force transmitting connection element according to claim 9, wherein at least one of the transverse force transmitting elements comprises an angled portion external to the insulation body.

17. The compressive force transmitting connection element according to claim 10, wherein the transverse force transmitting elements forming the at least one pair of transverse force transmitting elements is constructed to intersect in an area between a first support surface of the at least one compression element and a second support surface of the at least one compression element.

18. The compressive force transmitting connection element according to claim 11, wherein the transverse force transmitting elements forming the at least one pair of transverse force transmitting elements is connected to one another at least once at a distance from one another outside the insulation body.

19. The compressive force transmitting connection element according to claim 14, wherein the ratio between the transmissible compressive force and the transverse force measured in transmissible force units is greater than 5:1.

* * * * *